United States Patent [19]

Nakanishi et al.

[11] 4,330,108

[45] May 18, 1982

[54] METHOD FOR COOLING TUYERES

[75] Inventors: Kyoji Nakanishi, Chiba; Kenji Saito, Togane; Yoshiei Kato, Chiba; Tsutomu Nozaki, Chiba; Toshihiko Emi, Chiba, all of Japan

[73] Assignee: Kawasaki Steel Corporation, Kobe, Japan

[21] Appl. No.: 237,626

[22] Filed: Feb. 24, 1981

[30] Foreign Application Priority Data

Feb. 27, 1980 [JP] Japan ..... 55/22813

[51] Int. Cl.[3] ..... C21B 7/16

[52] U.S. Cl. ..... 266/47; 75/60; 266/46; 266/268

[58] Field of Search ..... 266/46, 47, 268; 75/59, 75/60

[56] References Cited

U.S. PATENT DOCUMENTS 3,330,645 7/1967 De Moustier ..... 75/60

4,089,677 5/1978 Spenceley ..... 75/59

*Primary Examiner*—P. D. Rosenberg

*Attorney, Agent, or Firm*—Balogh, Osann, Kramer, Dvorak, Genova & Traub

[57] ABSTRACT

In a method for cooling tuyeres when molten iron is refined by blowing a refining gas containing oxygen, and by setting tuyeres below or above the meniscus of iron bath in a vessel for refining the molten iron, wherein concentric tuyeres are used and a refining gas containing oxygen gas is blown through the inner pipe of the concentric tuyere and a fluid for protecting the tuyeres is blown through the outer pipe of the tuyere so that the protecting fluid surrounds the refining gas in a sheath form to cool the top ends of the tuyeres, the protecting fluid being a mixture of gaseous or liquid carbon dioxide and carbon fine particles.

1 Claim, 3 Drawing Figures

METHOD FOR COOLING TUYERES

The present invention relates to a method for cooling tuyeres for refining molten iron and particularly to a method for cooling tuyeres using a protecting fluid in the annulus of concentric tuyere.

As the protecting fluids of the double jet pipe tuyeres for refining molten iron, hydrocarbon gases used in oxygen bottom-blown converter usually known as OBM/Q-BOP, for example propane, butane, natural gas and the like, or kerosene used in a bottom-blown converter usually known as LWS have been heretofore well known. These already known protecting fluids flow in such a state that these fluids surround the oxidizing gas, particularly pure oxygen gas constituting an axial core flow of the above described tuyere in a sheath form, whereby the durable life of the tuyere is considerably prolonged. However, the above described protecting fluids contain hydrogen atom and a part of said hydrogen is absorbed in the molten iron and adversely affects the quality of the product.

In the bottom-blown converter for refining stainless steel usually known as AOD, protecting fluids containing no hydrogen atom, such as an inert gas, argon gas or nitrogen gas are used, but these gases are not thermally decomposed at high temperatures, so that these gases do not show the heat removing effect which satisfactorily cools the top end of the tuyere opening at the molten iron bath side and the durable life of the tuyere is not greater than 350 times and is inferior to the above described OBM/Q-BOP, which is 1000 times.

Other than the above described protecting fluids, it has been already well known to use gaseous or liquid carbon dioxide as the protecting fluid containing no hydrogen. For example, gaseous carbon dioxide is disclosed in Japanese Pat. No. 447,093. Liquid carbon dioxide is disclosed in Rev. Metallurgie (1978), P. 13–19. However, the cooling effect of carbon dioxide relies only upon the same small effect of removing heat as in argon gas or nitrogen gas as seen from the following discussion, because no decomposition reaction is caused which is different from that of hydrocarbons and kerosene. If an explanation is made with reference to propane used as a hydrocarbon heretofore, it has been known from experiment that the tuyere can be satisfactorily protected by supplying about 4% by volume based on oxygen gas in the axial core flow of the tuyere. The effect of said propane for removing heat is attained by two factors. One factor is sensible heat variation when propane gas is raised from room temperature to 1600° C. which is the temperature of the molten iron bath and another factor is heat removal owing to endothermic reaction when propane, $C_3H_8$ is decomposed at high temperature into C and $H_2$. The sum of the above described two endothermic amounts calculated by the well known thermodynamic constant is about 78 Kcal/mol.

In the case of gaseous carbon dioxide, the decomposition reaction does not occur even if the heating is effected up to 1600° C., and the tuyere is cooled only by the variation of sensible heat amount when carbon dioxide at room temperature is heated to 1600° C. Therefore, an amount of heat removed by gaseous carbon dioxide is calculated to be 18.4 Kcal/mol. Similarly, the endothermic amount when liquid carbon dioxide is used, is 21.5 Kcal/mol when the calculation is effected by using the well known thermodynamic constant and this value is not greatly different from the above described value of gaseous carbon dioxide. Accordingly, in order to obtain the same cooling effect as in 4% by volume based on oxygen of propane by using carbon dioxide, carbon dioxide corresponding to 15–7% by volume based on oxygen of gaseous carbon dioxide is necessary. However, if such a large amount of carbon dioxide must be used, even if the problem of hydrogen pick-up which has been a defect in view of quality, is solved, such a means is not only more expensive than the already known propane, but also the heat balance in the converter is greatly worsened and it is difficult to obtain the same blow finishing temperature unless iron ore is reduced by 25 kg/ton molten steel as compared with the usual blowing. This means that cheap iron ore can not be used as iron source and hence iron yield is lowered.

As mentioned above, the idea according to which carbon dioxide is used as the protecting fluid has been already proposed but this can not compete with the conventional method using propane in view of economy, so that carbon dioxide has not been commercially and practically used.

An object of the present invention is to provide an improved method for cooling tuyeres in which the defects possessed by the already known method for cooling tuyeres by using a protecting fluid have been obviated.

The present invention consists of a method for cooling tuyeres when a molten iron is refined by blowing a refining gas containing oxygen, and by setting tuyeres below or above the meniscus of the iron bath in a vessel for refining the molten iron, wherein concentric tuyeres are used and a refining gas containing oxygen gas is blown through an inner pipe of the concentric tuyere and a fluid for protecting the tuyeres is blown through the outer pipe of the tuyere so that the protecting fluid surrounds the refining gas in a sheath form to cool the top ends of the tuyeres and prevent the wear of the tuyeres, characterized in that the protecting fluid contains gaseous or liquid carbon dioxide and carbon fine particles, molar ratio of carbon to carbon dioxide being 0.5–1.0.

For better understanding of the invention, reference is taken to the accompanying drawings, wherein.

Figure 1:
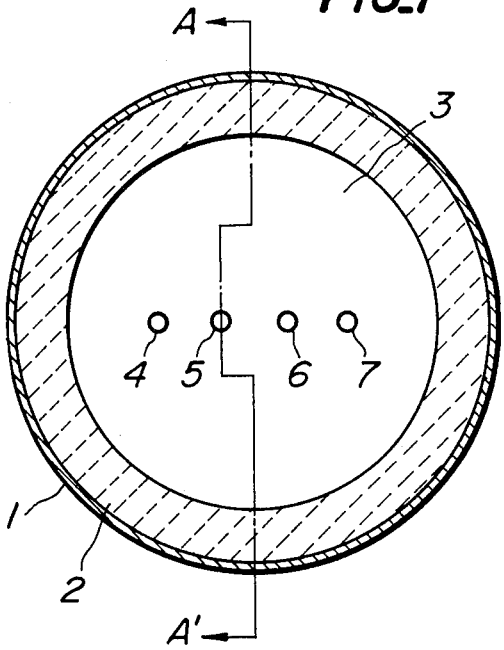
FIG. 1 is a transversal cross-sectional view of bottom surface of an oxygen bottom-blown converter.

The invention will be explained in more detail hereinafter.

As vessels for refining molten iron in the present invention, use may be made of a converter, electric furnace, open hearth furnace, and ladle type refining vessel and as molten iron, use may be made of iron-carbon molten metal, which is mainly molten iron of blast furnace, iron-carbon molten metal dissolving scrap obtained mainly from electric furnace and the like, and high alloy iron-carbon molten metal, the main raw material of which is high alloy scrap, which is refined in AOD furnace.

As a tuyere for refining molten iron to be used in the present invention, use may be made of an already known concentric tuyere (referred to merely as "concentric tuyere" hereinafter) and an oxidizing gas containing oxygen gas is passed through an inner pipe of the tuyere and a protecting fluid consisting of a mixture of carbon dioxide and carbon is passed through an outer pipe, that is an annular portion. A mixture ratio $\eta$ of carbon to carbon dioxide in the above described protecting fluid is defined by the following formula $$\eta = \frac{\text{moles of carbon (mol)}}{\text{moles of carbon dioxide (mol)}} \quad (1)$$

The inventors have made experiments by variously varying the above described $\eta$ and newly found that the highest heat removing ability can be obtained within a range of $0.5 \leqq \eta \leqq 1.0$.

When the protecting fluid consisting of a mixture of carbon dioxide and carbon is injected from the outer pipe that is annular portion of the concentric tuyere into lower portion of the molten bath according to the present invention, a reaction shown by the following formula (2) occurs around a top end of tuyere, which is exposed to the highest temperature and apt to wear.

$$CO_2 + C \rightarrow 2CO \quad (2)$$

The reaction of the above described formula (2) is an endothermic reaction, so that the heat removing ability is noticeably increased as compared with the prior case where carbon dioxide alone is injected into the molten metal as the protecting fluid.

As the result, as mentioned hereinafter, the equal durable life of the tuyere to the already known propane can be attained by 5% by volume based on oxygen of an amount of carbon dioxide consumed, which is an amount of about $\frac{1}{3}$ of the already known case of pure carbon dioxide and this is economically much better than the prior propane method and the problem of hydrogen pick-up, which deteriorates the quality of the product, is completely obviated.

The present invention will be explained with respect to experimental data.

On the bottom of a converter in which the wall portion is lined with magnesia-dolomite bricks and the bottom is built with magnesia-carbon bricks, four concentric tuyeres were arranged in one row in parallel to trunnion axis. Inner pipes through which oxygen gas is passed, were copper pipes, each having an inner diameter of 8 mm and an outer diameter of 12.7 mm and outer pipes through which the protecting fluid is passed, were copper pipes, each having an inner diameter of 13.7 mm and an outer diameter of 19.05 mm. Accordingly, the space of an annular portion formed by the inner pipe and the outer pipe was 0.5 mm.

The arrangement of the four tuyeres at the bottom is shown in FIG. 1. In FIG. 1, numerals 4, 5, 6 and 7 are the above described tuyeres, numeral 1 is steel shell and numeral 2 is refractory lining at side wall. The tuyeres 4 and 5 flow the protecting fluid (referred to as "protecting fluid of the present invention") consisting of a mixture of carbon dioxide and carbon powder and the tuyeres 6 and 7 flow the already known protecting fluid of propane gas.

Figure 2:
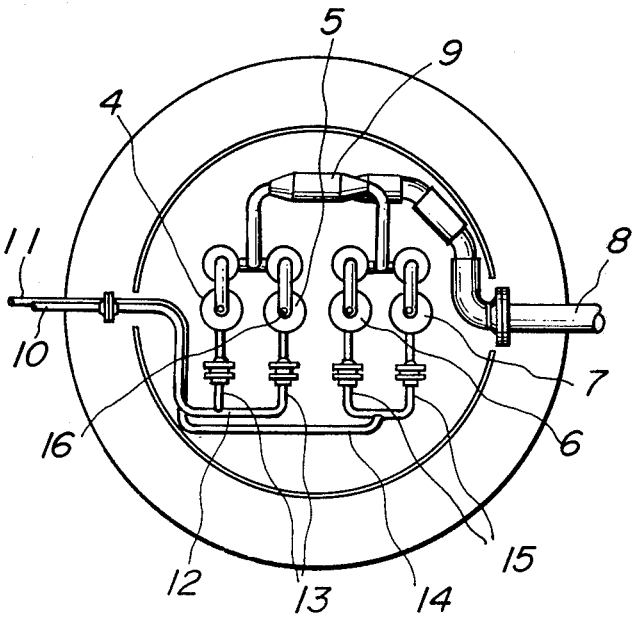
FIG. 2 is a bottom plan view of the back side of the converter in FIG. 1.
Figure 3:
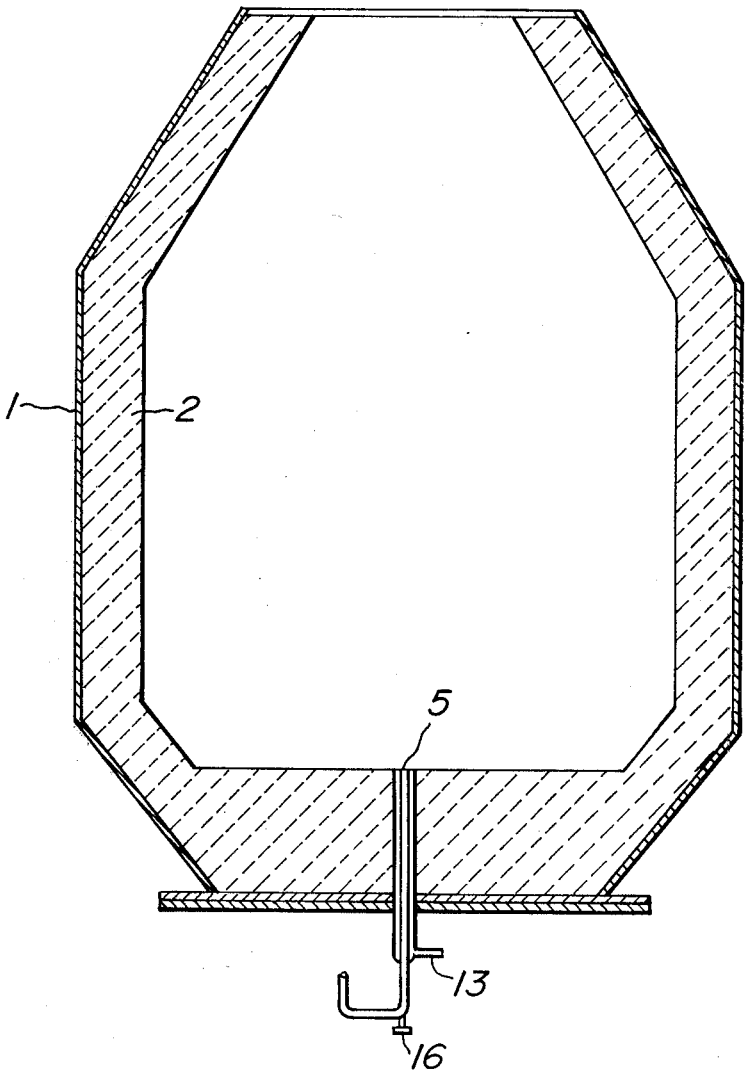
FIG. 3 is a vertical cross-sectional view taken along the line A—A' of the converter in FIG. 1.

A bottom plan view of a back side of the furnace bottom shown in FIG. 1 is shown in FIG. 2. In FIG. 2, numeral 8 is a pipe for feeding an oxidizing gas for refining, numeral 9 is a header for uniformly distributing the refining oxidizing gas into the above described four tuyeres and numeral 10 is a pipe for feeding the protecting fluid of the present invention and the fluid passes through pipe 12 and branched pipes 13 in order and is flowed into the annular portions in the tuyeres 4 and 5. Numeral 11 is a pipe for feeding propane gas and the propane gas passes through pipe 14 and branched pipes 15 in order and is flowed into the annular portions of the tuyeres 6 and 7. FIG. 3 shows a cross-sectional view taken along the line A—A' in FIG. 1. The pipes 10, 11 and 8 may flow argon gas or nitrogen gas other than the above described fluid. The furnace is inclined to the charging side and five tons of molten iron of blast furnace was charged therein. Components and temperature of the molten iron prior to charging into the converter were 4.5% of C, 0.4% of Si, 0.4% of Mn, 0.12% of P, 0.04% of S and 1260° C. and during charging the molten iron, nitrogen gas was flowed into the above described four tuyeres to prevent clogging of the pipes with the molten iron. Amounts of nitrogen gas flowed were 1.25 $Nm^3$/min in the inner pipe and 0.23 $Nm^3$/min in the annular portion per one tuyere. After completing the charge, the furnace was immediately turned in the perpendicular state and the blowing was started. The flowed amounts per one tuyere were as follows.

In the tuyeres 4 and 5, 1.25 $Nm^3$/min of oxygen gas flowed through the inner pipe and the protecting fluid of the present invention consisting of a mixture of 0.063 $Nm^3$/min of carbon dioxide gas and 0.034 $Nm^3$/min of carbon powder flowed through the annular portion. In the tuyeres 6 and 7, the inner pipe took 1.25 $Nm^3$/min of oxygen gas and the annular portion took 0.05 $Nm^3$/min of already known propane gas. In this case, at the same time as the refining gas is blown from the bottom, an already known water cooling top-blown lance for LD converter was inserted into a converter and oxygen gas was blown to the bath surface in an amount of 5 $Nm^3$/min of oxygen gas to supplement the amount of gas blown from the bottom. At the same time as starting the blowing, 150 kg of burnt lime was added from the top to the bath surface. After blowing for 20 minutes, the blowing was exchanged to the above described amount of nitrogen gas (the inner pipe: 1.25 $Nm^3$/min, the annular portion: 0.23 $Nm^3$/min per one tuyere) and oxygen gas fed from the top-blown water cooling lance also was stopped and said lance was pulled up from the converter opening. Then, when the converter was immediately inclined to the charging side and the temperature of the molten iron was measured and the sampling was effected, the temperature was 1646° C., C, Mn, P and S were 0.03%, 0.23%, 0.017% and 0.018% respectively. Then, the converter was inclined to the side of a hole for discharging the molten steel and the molten steel was taken out to a ladle, after which the converter was again inclined to the charging side and the molten slag was taken out into a slag ladle. Thus, after the converter was emptied, set screws shown in FIGS. 2 and 3 were removed and the length of the tuyere was measured and the amount of the tuyere wear due to the above described blowing was determined and the following values were obtained.

| Tuyere No. | Amount of wear |
|---|---|
| 4 | 1.7 (mm/ch) |
| 5 | 1.3 |
| 6 | 2.3 |
| 7 | 2.3 |

The amount of wear is an average value of the values measured at six points in the circumferential direction. Although the amount of carbon dioxide gas used in the present invention is an amount as small as 5%, protecting effect equal to or hither than that of propane gas was shown. Accordingly, it is considered that the heat removal owing to the above described formula (2) is sufficient at the circumference of the tuyere and the noticeable improvement which is superior to the prior protecting fluid of carbon dioxide alone, is recognized. In addition, the protecting fluid does not contain a hydrogen-containing substance, such as propane, so that it is apparent that the same hydrogen concentration as in LD converter steel can be attained at the blow end and the effect of the present invention is apparent.

According to the inventors' experiments, it has been found that there is a moderate range in the mixture ratio of carbon dioxide gas and carbon required in order to obtain the effective cooling of the tuyere in a relatively small amount of carbon dioxide gas. That is, when the value of above mentioned $\eta$ is less than 0.5, unless a flow rate of carbon dioxide gas becomes more than 10% (by volume) of flow rate of oxygen, the satisfactory cooling effect can not be obtained. Even if a the value of $\eta$ made is larger than unity, the cooling effect is not increased.

Then, by using the protecting fluid of the present invention in which the flow rate and composition per one tuyere in the annular portion are the same as in the above described experiment, the same experiments as described above were carried out. After 10 heat exposures of successive blowings, the amount of the wear of tuyeres was measured and the amount was 1.1 mm per heat exposure. When samples were taken out from the molten bath in the converter at the blow end with respect to the 10 heat exposures and analyzed, the hydrogen content was 1.7 ppm±0.4 ppm.

For comparison with the above described experiment, another experiment, including blowings was successively carried out involving five heat exposures under the same condition as in the above described experiment according to the present invention except for using propane gas in the same flow rate at the annular portion per one tuyere as in the above described experiment to all tuyeres 4, 5, 6 and 7. After the five heat exposures, the amount of wear of the tuyeres was determined and the amount was 1.5 mm per heat exposure. The hydrogen content of the molten steel taken out from the converter at the blow end was 4.9 ppm±0.7 ppm. From these results, it is apparent that the present invention is superior to the prior method.

The present invention can provide a method for effectively cooling the tuyeres when the blowing is effected by setting the tuyeres above the meniscus of the metal bath, as well as when the tuyeres are set below the meniscus of the metal iron bath.

The present invention can provide an excellent method for cooling the tuyeres in which the wear of the top end of the tuyere is very small.

What is claimed is:

1. In a method for cooling tuyeres when molten iron is refined by blowing a refining gas containing oxygen by setting tuyeres below or above the meniscus of iron bath in a vessel for refining the molten iron, wherein concentric tuyeres are used and a refining gas containing oxygen gas is blown through an inner pipe of the concentric tuyere and a fluid for protecting the tuyeres is blown through the outer pipe of the tuyere so that the protecting fluid surrounds the refining gas in a sheath form to cool top ends of the tuyeres and prevent the wear of the tuyeres, the improvement comprising using a mixture of at least one member of the group consisting of carbon dioxide gas, carbon dioxide liquid and a mixture of carbon dioxide gas and liquid, and carbon fine particles as the protecting fluid, molar ratio of carbon to carbon dioxide being 0.5–1.0.

* * * * *